United States Patent [19]

Jones

[11] Patent Number: 4,502,554

[45] Date of Patent: Mar. 5, 1985

[54] EXPANSIBLE TOOL FOR REAMING FRUSTOCONICAL UNDERCUTS IN CYLINDRICAL HOLES

[76] Inventor: Richard H. Jones, P.O. Box 108, Baton Rouge, La. 70821

[21] Appl. No.: 384,252

[22] Filed: Jun. 2, 1982

[51] Int. Cl.[3] ..... E21B 7/28

[52] U.S. Cl. ..... 175/285; 175/211

[58] Field of Search ..... 175/285, 286, 289, 209, 175/207, 211, 406

[56] References Cited

U.S. PATENT DOCUMENTS

| | | | |
|---|---|---|---|
| 2,832,568 | 4/1958 | Kammerer, Jr. | 175/286 |
| 2,953,362 | 9/1960 | Thassy | 175/286 X |
| 3,220,478 | 11/1965 | Kinzback | 175/289 |

FOREIGN PATENT DOCUMENTS

| | | | |
|---|---|---|---|
| 0043000 | 1/1982 | European Pat. Off. | 175/289 |
| 2652366 | 11/1976 | Fed. Rep. of Germany | 175/285 |
| 2921696 | 5/1979 | Fed. Rep. of Germany | 175/286 |
| 3020143 | 5/1980 | Fed. Rep. of Germany | 175/286 |

*Primary Examiner*—Stephen J. Novosad
*Assistant Examiner*—Michael Starinsky
*Attorney, Agent, or Firm*—Keaty & Keaty

[57] ABSTRACT

An improved expansible rotary power tool for reaming frustoconical undercuts in cylindrical holes contained in dense concrete, such as flint and chert aggregates, comprises a tool having a hollow elongated sheath provided with a pair of opposing longitudinal slots adjacent to the cutting end of the tool. An upwardly biased tubular ram is reciprocally disposed within the sheath and is provided with a clevis at its cutting end which extends into the longitudinal slots, and a power engaging head at the end of the tool which projects out of hole being undercut. A load bearing collar mounted adjacent the power engaging end of the tool provides a stop against which the tool rests to determine the degree of advancement of the tool into the hole. A pair of elongated flat cutters are pivotally mounted back to back in the clevis of the ram, and advancement of the ram against the bias of the spring and into the hole flares the cutters outwardly through the slots to undercut the walls of the hole when the tool is rotated. Diamond impregnated cutting blades are mounted on a longitudinal recess along the cutting edge of the cutters with the plane of said diamond impregnated face being disposed at an acute angle of eighteen and five-tenths degrees to the cutting edge of the cutters. Cooling and flushing fluid is introduced into the tubular ram and is conveyed towards the cutters and through a pair of opposing beveled recess channels between the opposing backs of said cutters, thereby cooling and flushing said cutters during reaming.

6 Claims, 11 Drawing Figures

EXPANSIBLE TOOL FOR REAMING FRUSTOCONICAL UNDERCUTS IN CYLINDRICAL HOLES

BACKGROUND OF THE INVENTION

1. Field of the Invention

The present invention relates to reaming frustoconical undercuts in cylindrical holes for placement of expansible bolts therein. More particularly, the invention relates to an improved, expansible rotary power tool for reaming frustoconical undercuts in cylindrical holes in flint and chert concrete using diamond impregnated blades disposed on the leading edge of expandable cutter elements in such fashion as to maximize the surface area of the cutter blade being used. In addition, cooling and flushing fluid is provided to the undercutting end of the tool to prevent deterioration of the blade and flush away particles of the material being cut.

2. General Background

Various apparatus are known which attempt to ream frustoconical undercuts in the walls of cylindrical holes drilled in concrete. The purpose of undercutting the holes is to provide a frustoconical opening within a cylindrical hole for placement of an expansible anchor bolt. This structure is particularly useful in setting bolts in an existing concrete, stone or other masonary structure where the hole is drilled after the structure is built, as distinguished from a wall having bolts embedded therein before the concrete sets. The undercutting of the hole greatly increases the reliability of the anchor bolt, as compared with an anchor bolt set into a hole having only cylindrical walls and relying on friction to prevent withdrawal of the bolt after it has been expanded. The superior reliability of the anchor bolt accounts for its extensive use in such "fail safe" structures as nuclear reactor containment facilities.

A very early attempt to provide a reamer having sufficient stability and accuracy to adequately undercut the walls of a hole is disclosed in U.S. Pat. No. 1,710,580 issued to LeBus. The reamer comprised a tubular body having an internal sleeve which advanced downwardly against an upwardly curving cutter blade to force the blades downwardly into a horizontal cutting position.

U.S. Pat. No. 1,824,238 issued to Scott for an oil sand bit having a slotted body with a stem sliding therein, the stem being adapted for attachment to a drill pipe. Two blades were pivotally mounted in the slotted body, and the cutting edges of the blades were forced outwardly into a flared cutting position by a downward movement of the stem into the body. Another attribute of this invention was the inclusion of a hollow stem for attaching a water source to the tool and conveying a water supply to the pivotally mounted blades for flushing and cooling purposes.

U.S. Pat. No. 2,060,352 issued to Stokes and discloses a hollow, expansible drill having a plunger located adjacent a pair of pivotally mounted cutter blades. Introduction of fluid into the hollow tool caused the plunger to move downwardly on the slanted upper portions of the pivotally mounted cutter blades, thereby hydraulically extending the cutter blades to their horizontal operating position. Cessation of introduction of the fluid would result in the retraction of the blades into the body of the tool.

U.S. Pat. No. 2,216,895, issued to Stokes, also disclosed a rotary underreamer having a pair of pivotally mounted cutter blades which were extended to their horizontal, operating position by the introduction of a fluid under pressure into the hollow cutting tool.

U.S. Pat. No. 2,872,160 issued to Barg for an hydraulic expansible rotary well drilling bit capable of discharging drilling fluid at the bottom of the bit to ensure upward flushing and removal of the cuttings to the top of a well bore. The expansible drill bit cutters were expanded outwardly by hydraulic pressure which urged a plunger device downwardly against the force of a spring, thereby actuating a rack and pinion device to swing a pair of pivotally mounted blades from a vertical, inoperative position to a flared, horizontal operating position.

U.S. Pat. No. 2,997,119 issued to Goodwin for a drill bit assembly having separately mounted pivotal cutter blades with U-shaped flanges for receiving a plunger head. When the plunger head was advanced into the hole being cut, the separately mounted cutter blades were tilted outwardly into a horizontal position for underreaming purposes.

More recently U.S. Pat. No. 4,091,882 issued to Hashimoto for a drilling tool for use in embedding an anchor bolt with synthetic resin adhesive in a concrete bed.

An expansible drill bit for underreaming a hole while providing circulation of drilling fluids at all times during the underreaming process and afterwards, is the subject of U.S. Pat. No. 3,365,010 issued to Howell et al.

The flaws with the tools in the prior art are most dramatically illustrated in U.S. Pat. No. 4,307,636 issued to Lacey. U.S. Pat. No. 4,307,636 discloses structure for a drilling tool similar to the tool of the present invention, but without providing a means for introducing cooling and circulating fluid into the vicinity of the blades. The forward advance of the interal ram into the surrounding sheath was stopped at a predetermined point only by pin 34, and this pin was subject to breakage and subsequent flaring of the cutting blades to a greater than desired diameter. In addition, the Lacey patent failed to disclose the proper geometric relationship at which to place cutting blades on the cutters to achieve accurate undercutting in concrete having a significant flint and chert content.

GENERAL DISCUSSION OF THE PRESENT INVENTION

The preferred embodiment of the apparatus of the present invention provides a device for reaming frustoconical undercuts in cylindrical holes. The present device is especially useful in undercutting holes which have been drilled in very dense concrete, such as concrete having a high flint and chert content. This very dense concrete is particularly prevalent in parts of the South and Northwest, and undercutting in these regions has heretofore been exceedingly arduous. The carbide blades used would deteriorate when undercutting in the flint and chert concrete. The present device has solved the problems of the prior art by providing replaceable diamond impregnated cutting elements mounted in longitudinal slots on the cutting blades. Flushing and cooling fluid is also provided to protect the blades from deterioration due to frictional heat and particle blockage of the hole.

The tool which is the subject of this invention comprises a hollow cylindrical sheath which is longer than the pre-formed hole which the tool must undercut, the sheath having two longitudinally extending, diametrically opposed guide slots adjacent the cutting end of the tool. Two cutters are pivotally mounted back to back on a pin inside the longitudinal slot so that each of the blades can rotate about the pivot and extend its cutting edge outwardly through one guide slot and extend its opposite edge into the opposite guide slot. A tubular ram having an axial bore is disposed in sliding relationship within the sheath, and is provided with a clevis at one end projecting into the slotted opening in the sheath. A pin transfixes the ram and extends into a longitudinally extending limit slot in the walls of the sheath to impart torque to the sheath when the ram is rotated by a rotary power source. A helical power coil spring rests on a recessed shoulder within the sheath, and extends upwardly against an enlarged head of the rod for biasing the sheath and rod in longitudinally opposite directions. The rod is hollow and is provided with a water supply to propel water downwardly through the axial bore of the ram and towards the cutting end.

Elongated, flat cutters each have a cutting edge and a supporting edge and are pivotally mounted back to back in the clevis of the ram by a clevis pin extending through a diagonal slot in each cutter. The diagonal slots are oriented in the cutters such that when the ram is pushed deeper into the shaft, the clevis pin forces the cutters to pivot about a second pin transfixing the sheath so that their cutting edges extend transversely oppositely outwardly through the slots, and when the ram is retracted by a return spring the cutters are withdrawn inside the periphery of the shaft.

Each of the cutters is provided with a replaceable parallelepiped-shaped blade having a diamond impregnated face, the blade being mounted on a longitudinal recess along the cutting edge of the cutter such that the surface plane of the diamond impreganted face is disposed at an acute angle to the plane of the cutting edge, usually at 18.5 degrees in an undercutting tool for reaming a one and one-eighth inch maximum diameter frustroconical hole. In undercuts having smaller diameters, the degree of incline may be as much as 22°, and in undercuts having very large diameters, the degree of incline will be close to 5°, and perhaps as small as 1°.

A load bearing collar is mounted on the sheath adjacent the power engaging end of the tool for stopping the advancement of the sheath into the hole being undercut. The position of the collar may be varied to alter the depth at which the cylindrical hole is being undercut. The collar is provided with a plurality of transverse notches for permitting the egress of flushed concrete particles and water.

The power engaging end of the reciprocal ram is connected to a manifold having a rotary power drive and water hose attached thereto. When torque is imparted to the reciprocal ram by initiation of operation of the rotary power drive, water is introduced through the hose attached to the manifold for cooling and flushing of the cutters while the reaming is in progress. Flushing of the cutter blades is facilitated by a pair of beveled fluid channeling recesses in the back surface of the sides of the blades which direct the water hitting the top of the cutters downwardly to the cutting edges instead of displacing the water outwardly towards the walls of the sheath. The flushing process is further enhanced by placement of a series of fluid egress notches in the load bearing collar, thereby permitting fluid and cuttings to be flushed out of the hole during undercutting.

Therefore it is an object of the present invention to provide a reamer which is capable of undercutting frustoconical undercuts in the walls of cylindrical holes in very dense concrete, such as concrete having a high flint and chert content. The present tool has a number of features designed to permit accurate undercutting of holes in such dense concrete. These features include a blade having a diamond impregnated face disposed on a surface plane running at an acute angle to the surface plane of the cutting edge of the cutter, in conjunction with the use of flushing and cooling fluid.

It is still a further object of the present invention to provide a tool that will consistently undercut cylindrical holes at the same depth. This object is achieved by providing a load bearing collar which is reinforced by a round keeper for preventing longitudinal displacement of the collar during reaming.

It is still a further object of the invention to provide frustoconical undercuttings of consistently identical dimensions by providing the abutment of the sheath and enlarged head portion of the ram to stop the longitudinal advance of the ram into the sheath. A recessed, spring supporting shoulder is provided inside the sheath so that the bias of the spring will not have been entirely overcome before the enlarged head abuts the sheath. Such an arrangement obviates reliance on a pin transfixing the rod and extending into a limit slot for determining the point of maximum longitudinal advancement of the ram. The advantage of obviating reliance on the pin is that the pin can be easily broken under the stressful conditions in which the tool is being used. If the pin breaks, the longitudinal advancement of the ram into the sheath is permitted to continue unabated, and the cutters consequently flare to a greater extent than desired, thereby cutting a frustoconical section of greater diameter than job specifications permit.

It is still a further object of the present invention to provide replaceable cutting elements which may be soldered in longitudinal slots on the cutting edge of the cutters to permit the worn cutting elements to be disposed without needing to discard the entire cutter as well.

It is still a further object of the present invention to enhance the unobstructed flow of cooling and flushing fluid to the cutters by providing a beveled fluid channeling recess in the opposing rear faces of the cutters for providing a channel through which fluid may travel and be directed downwardly against the cutting surfaces where most of the heat and cuttings are generated. Absent such a channel, the fluid flowing downwardly through the hollow ram would be primarily transversely displaced towards the walls of the sheath when it reached the upper end of the cutters.

BRIEF DESCRIPTION OF THE DRAWINGS

For a further understanding of the nature and objects of the present invention, reference should be had to the following detailed description taken in conjunction with the accompanying drawings, in which like parts are given like reference numerals and wherein.

DETAILED DESCRIPTION OF THE PREFERRED EMBODIMENT

Figure 1:
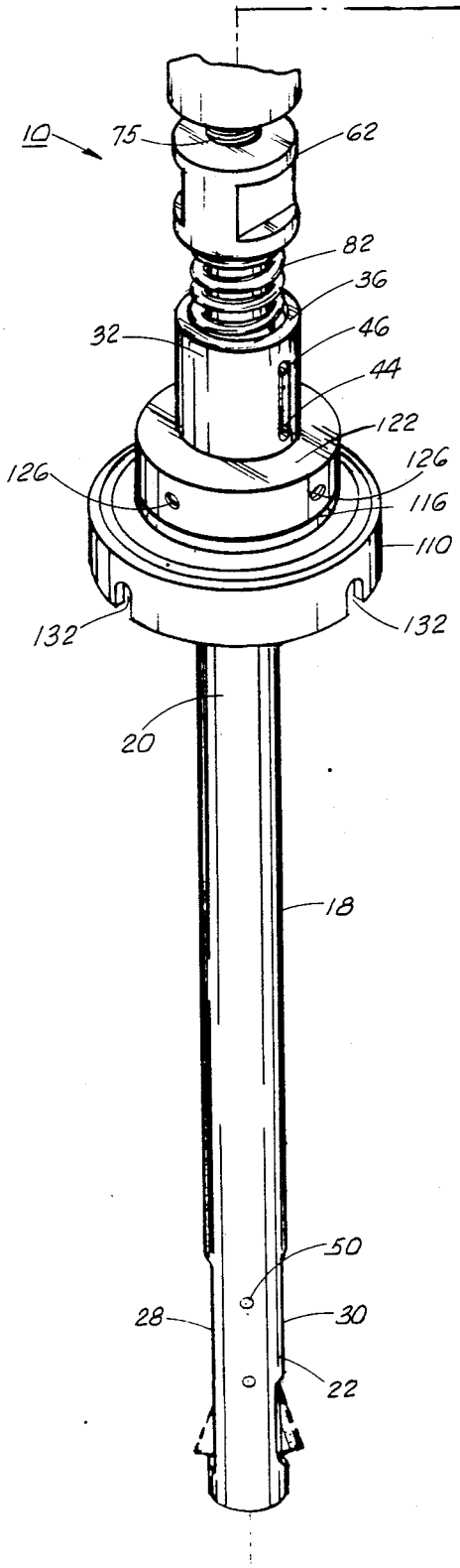
FIG. 1 is a fragmentary, top perspective view of the preferred embodiment of the expansible rotary power tool with the cutters retracted, phantom lines indicating the position of the cutters when they are expanded.

FIGS. 1-10 show the preferred embodiment of the expansible rotary power tool 10 for reaming frustoconical undercuts 12 in the concrete walls 14 of cylindrical holes 16.

Tool 10 is comprised of an elongated cylindrical sheath 18 having a power-engaging upper end 20 and a wall cutting lower end 22. An axial passageway 24 passes through upper end 20 of tool 10 and extends substantially the length of sheath 18, being bounded on lower end 22 by butt 26. The sheath is provided with a pair of opposing longitudinal slots 28, 30 disposed adjacent said lower end 22 of tool 10 and communicating with said passageway 24.

In the preferred embodiment of the present invention, upper end 20 has an enlarged diameter portion 32 which has an outside diameter greater than the outside diameter of the remainder of sheath 18. The inside diameter of portion 32, however, remains the same as the inside diameter of the remainder of sheath 18. Portion 32 is provided with an internal, spring supporting shoulder 34 (see FIG. 4) for receiving a spring, to be described below. Portion 32 has a circular upper lip 36, arcuately depending interior wall 38, shoulder 34 and internal sheath wall 40.

Machine threaded screw slots 42 are circumscribed around the periphery of portion 32. A longitudinal limit slot 44 is disposed intermediate slots 42 and lip 36 for receiving limit pin 46 having central fluid flow permitting recess 48 for transfixing the reciprocating ram described below.

A pair of clevis pin receiving openings 50 are opposingly disposed on the slotted lower end 22 of sheath 18, and are adapted to receive clevis pin 52 therebetween for pivotally mounting cutter blades to be described below. Pin 52 has a length less than the internal diameter of sheath 18, and is short enough to clear internal wall 40 of sheath 18. A pair of pivot pin receiving openings 54 are opposingly disposed along the slotted portion of lower end 22 at a point closer to butt 26 than opening 50. Opening 54 is disposed to operatively receive pivot pin 56 therewithin.

An elongated tubular ram 58 is disposed within sheath 18, the outside diameter of ram 58 being slightly less than the inside diameter of sheath 18. Ram 58 has an axial bore 60 extending the entire length thereof, best seen in cross-section in FIG. 3 as a broken line. Ram 58 has an enlarged power engaging head 62 having internal screw threads 64 therein for threadably engaging a power source.

The lower end 66 of ram 58 is provided with a clevis 68 having a pair of opposed clevis pin receiving openings 70 disposed about half way down the walls of clevis 68. A pair of opposed stop pin openings 72 are also provided in ram 58 in a portion of the ram proximate to head 62. When ram 58 is reciprocally disposed within sheath 18, opening 72 is substantially aligned with slot 44, so that pin 46 transfixes sheath 18 and ram 58. Similarly, opening 70 is substantially aligned with opening 50 so that pin 52 may be placed through opening 50 and into opening 70 to transfix clevis 68 and a pair of cutters described below without transfixing sheath 18.

Figure 2:
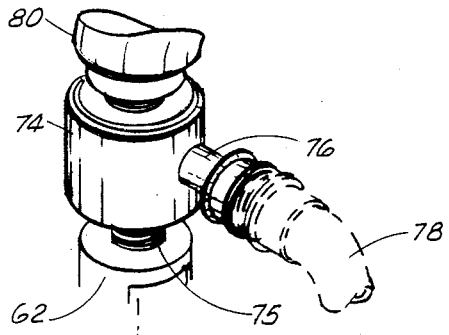
FIG. 2 is a fragmentary, top perspective view showing the power engaging end of the tool.

Ram 58 is further provided with manifold 74 which is threadably engaged with threads 64 of head 62 (see FIG. 2) by manifold inlet 75. Manifold 74 has a transversely extending arm 76 to which a conventional water hose 78 may be engaged, as shown in FIG. 2. A rotary power source 80 is coupled to manifold 74 for imparting torque to ram 58.

A helical power coil spring 82 is disposed in surrounding relationship to ram 58 between portion 32 on end 28 of sheath 18 and head 62 of ram 58. Spring 82 rests on shoulder 34 within portion 32.

A pair of elongated, flat cutting portions 84, 86, each having parallel front and rear cutter surfaces 85, 87 are pivotally mounted back-to-back by pin 52 transfixing ram 58, pin 52 being inserted through diagonally extending slots 88, 90. Pivot pin receiving openings 92, 94 are centrally disposed in cutting portions 84, 86 respectively, and pin 56 transfixes sheath 18 through opening 54 and cutting portions 84, 86 through openings 92, 94.

Cutting portions 84, 86 each have cutting faces (96, 98) and supporting edges 100, 101, side 96 resting on edge 101 and side 98 resting on edge 100.

Cutting portions 84, 86 each have a parallelepiped-shaped replaceable blade 102 (only one being shown in FIGS. 5-9) having diamond impregnated cutting surface 104. Blade 102 is silver soldered into a longitudinal recess 106 on the front face 85 of cutters 84, 86 along cutting sides 96, 98. A very important aspect of the present invention is the geometric disposition of diamond impregnated cutting surface 104 within recess 106. Blade 102 is disposed within recess 106 so that the plane of diamond impregnated cutting surface 104 is at an 18.5 degree angle to the surface planes of cutting sides 96, 98 (see FIG. 9). The 18.5° angle is appropriate for a frustoconical undercut having a $1\frac{1}{8}$ inch maximum diameter. The angle of incline will vary from a minimum of about 1° when a hole having a diameter greater than $1\frac{1}{2}$ inches is being drilled to a maximum of about 22° when very small diameter undercuts are being reamed. It has been shown by experimentation that placement of the blade at these angles permits a greater area of diamond impregnated surface 104 to engage the walls 14 of the hole being cut. Prior art blades, particularly those of the carbide variety, have been integral parts of the elongated cutters, causing the cutting surface to be contained in the same plane as the front face of the cutter. It has been found, however, that cutting surfaces which are flush with the front surface of the cutter provide too little cutting surface to consistently underream holes being cut in concrete containing large amounts of flint and chert.

Figure 8:
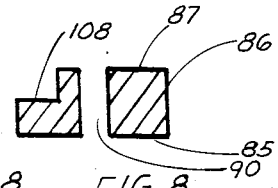
FIG. 8 is a view along line 7—7 of FIG. 7.
Figure 6:
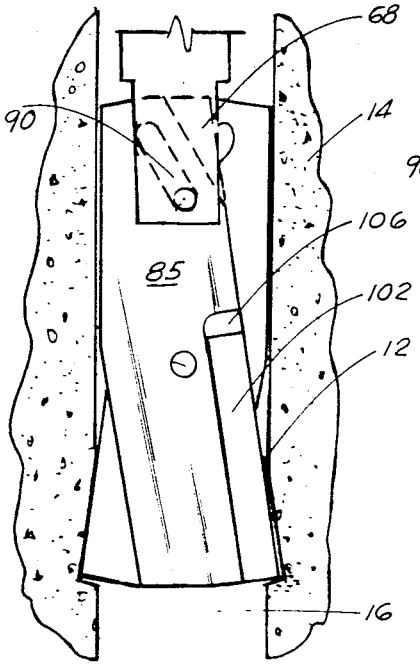
FIG. 6 is a view similar to FIG. 5 wherein the blades have been expanded into undercutting relationship with the surrounding walls of the hole.
Figure 7:
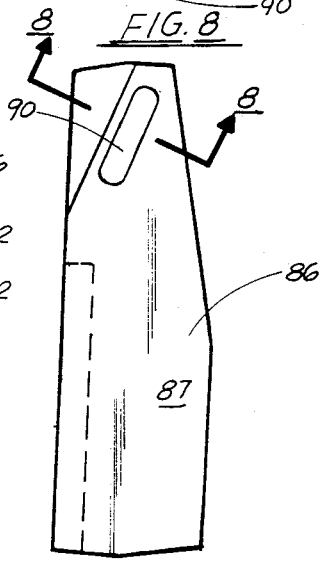
FIG. 7 is a plan view of the rear face of one of the cutters showing the beveled fluid channeling recess, the blade on the opposite face of the tool being shown in phantom.
Figure 11:
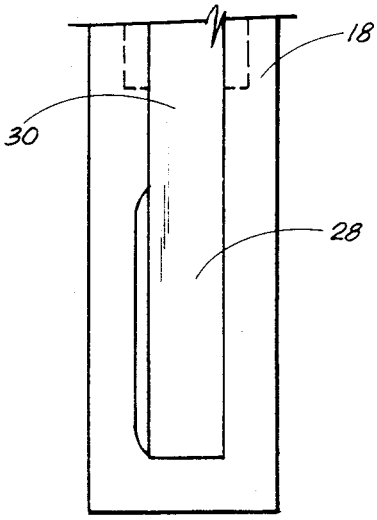
FIG. 11 is a fragmentary, side view of the cutting end of the sheath of the tool.

Cutting portions 84, 86 are each provided with a bevelled recess fluid channel 108 for helping direct the downward flow of water to the blades 102 (See FIGS. 7 and 8). The benefit of channels 108 is their cooperative ability to direct flushing fluid coming down through bore 60 more directly towards blades 102. Without channels 108, fluid traveling downwardly through bore 60 would be primarily displaced transversely without reaching blades 102.

Figure 3:
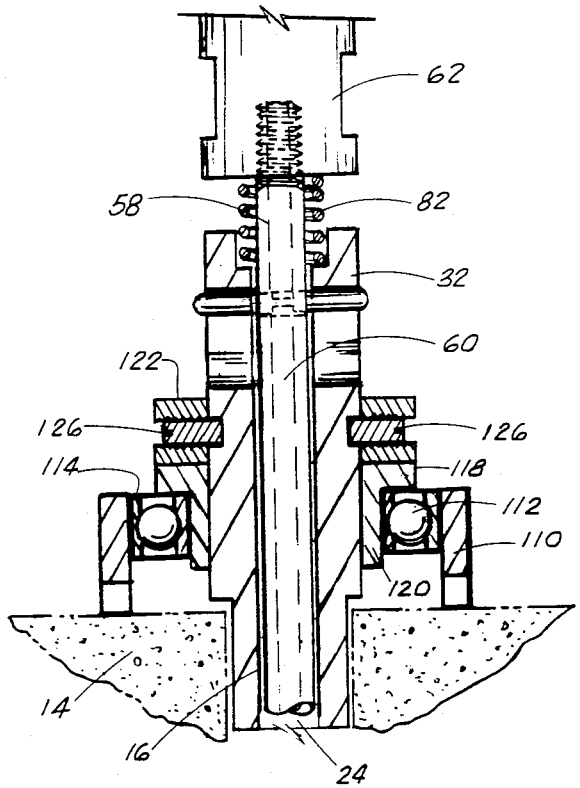
FIG. 3 is a cross-sectional view of the tool disposed in a cylindrical hole bored in concrete, showing particularly the load bearing collar, the inner seat, round keeper, recessed spring supporting shoulder and enlarged head.

Tool 10 is further provided with a load bearing collar 110 which is mounted in surrounding engagement to end 20 of sheath 18 just below portion 32 for stopping the advancement of tool 10 into hole 16 being undercut. Collar 110, as best seen in FIG. 3, is comprised of a roller ball and bearing assembly having a ball 112 mounted in bearing assembly 114. This arrangement renders assembly 114 rotatable, while collar 110 may remain stationary.

Figure 4:
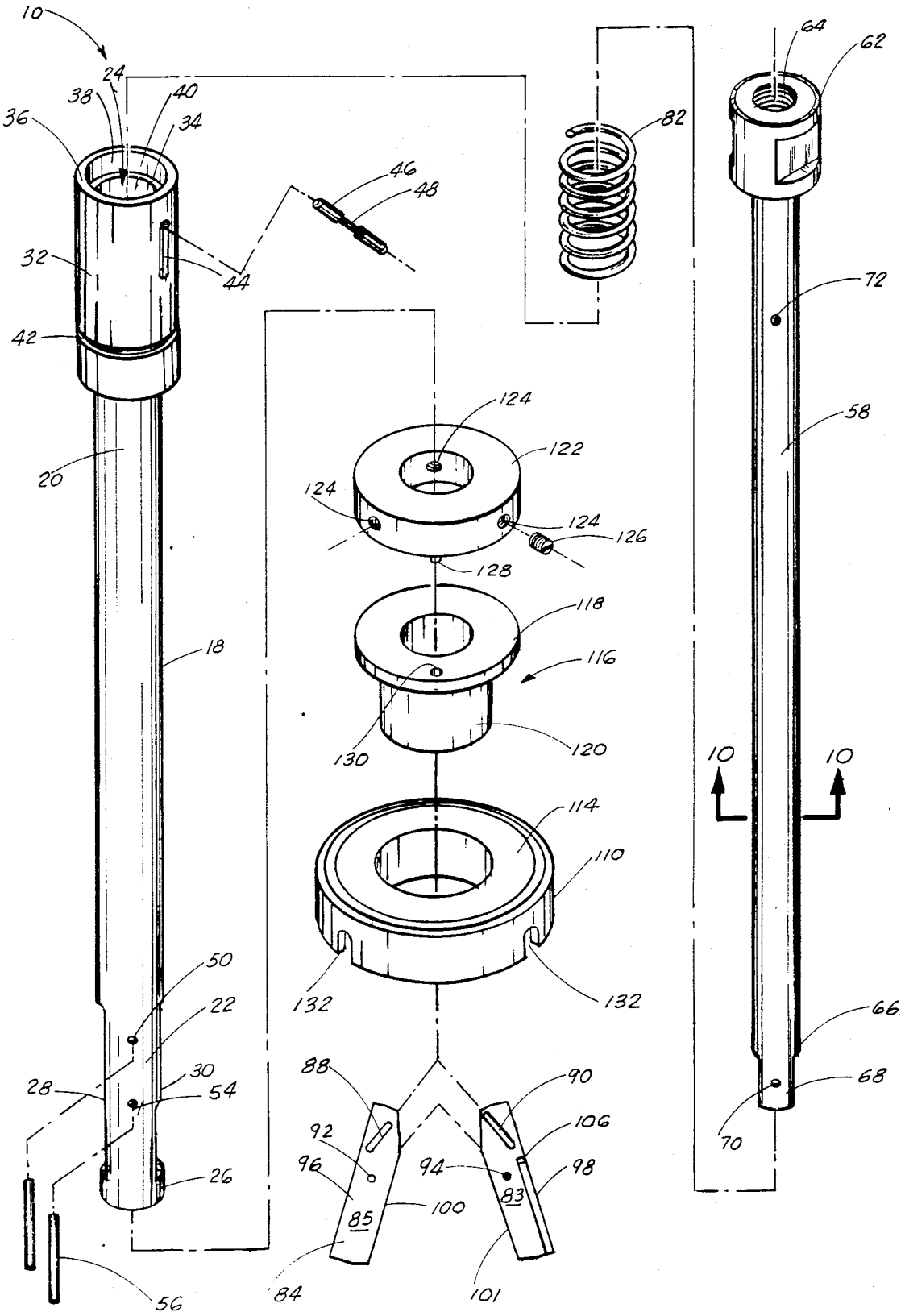
FIG. 4 is an exploded view of the tool shown in FIG. 1.
Figure 5:
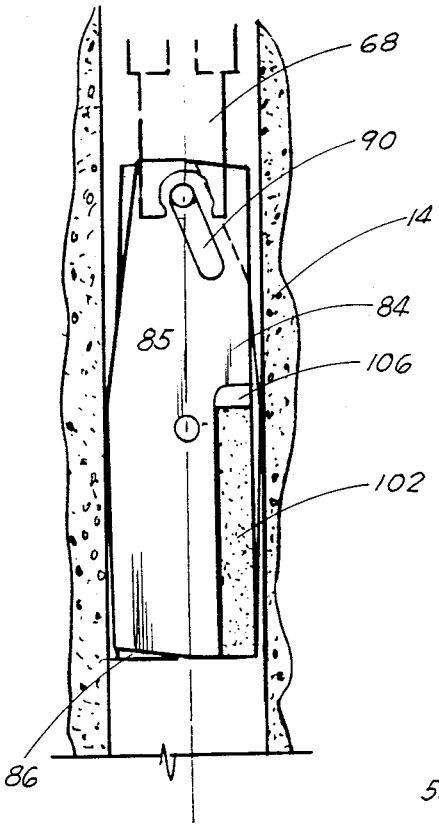
FIG. 5 is a fragmentary side view of the cutters disposed within a concrete hole, the blades being in a retracted position.
Figure 9:
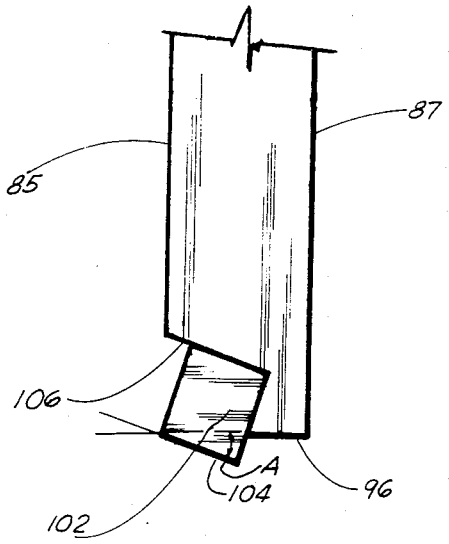
FIG. 9 is an enlarged, fragmentary end plan view of one of the cutters showing the parallelepiped shaped blade having a diamond impregnated face.
Figure 10:
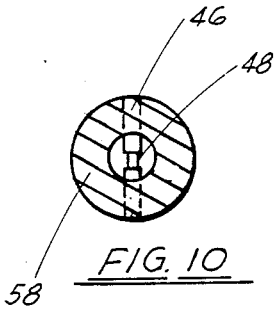
FIG. 10 is a cross-sectional view of the sheath of the tool taken along line 10—10 of FIG. 4 showing the torque imparting pin interfixing the walls of the sheath.

An inner seat 116 having a flanged lip 118 and depending skirt 120 is disposed in fixed surrounding relationship to said sheath, skirt 120 fitting within the central opening of assembly 114, and lip 118 resting on assembly 114. A round keeper 122 has three screw holes 124 and three corresponding pressure screws 126, only one of which is shown in FIG. 4. Screws 126 are threaded into holes 124 for tightly engaging with slot 42 and holding keeper 122 firmly engaged with sheath 18. A depending stud 128, which is integral with keeper 122, is inserted in stud receiving opening 130 for turning seat 116 with keeper 122. The keeper also prevents longitudinal displacement of collar 110 during reaming.

It should also be noted that collar 110 contains a sealed bearing to protect the bearing while water and concrete cuttings are being flushed from the hole. To enhance the egress of fluid and cuttings from the hole, U-shaped notches 132 are provided in collar 110.

In operation, tool 10 (as best seen in FIG. 1), is placed in hole 16, the degree of inward progression of tool 10 being determined by the location of collar 110, which is positioned to permit cutters 84, 86 to advance to the desired depth in hole 16. Before cutting begins, spring 82 biases head 62 of ram 58 longitudinally upwardly away from sheath 18, thereby holding cutters 84, 86 at the uppermost point of intersection of slots 88, 90. In this disposition, the elongated blades are recessed within sheath 18.

When undercutting is to begin, rotary power source 80 is activated, and torque is transmitted to the cutters. Pins 46, 56 transfix sheath 18 and impart rotary movement to it as well. When rotary action is initiated, a water source (not shown) is tapped, and water is supplied under pressure through hose 78 into manifold 74 and thereafter downwardly into bore 60, whence it is conveyed to cutters 84, 86 through passageway 108, thereby cooling the cutters and flushing out particles of concrete that will be sheared from walls 14.

The cutters 84, 86 are expanded by a downwardly pressing action of source 80, which forces head 62 downwardly towards lip 36 of sheath 18. The point of utmost downward progression of head 62 occurs when head 62 abuts lip 36 of sheath 18. This arrangement obviates the neccesity for relying on limit pin 46 to stop the downward advance of the ram within sheath 18. The advantage of obviating reliance on pin 46 is that the pin can be broken under the stress of drilling, thereby permitting the ram to travel downwardly beyond the desired stop point, thereby imparting additional expansion to the blades and undercutting a frustoconical section of greater diameter than desired. In such an instance, the hole will have been ruined.

As ram 58 advances downwardly against the bias of spring 82, under the influence of the downward action of source 80, pin 52 is forced downwardly through slots 88, 90, expanding cutting sides 96, 98 outwardly since the blades are also transfixed by pin 56 through openings 54, 92, 94.

As the blades expand outwardly, the diamond impregnated diamond impregnated cutting surface 104 engages walls 14 of hole 16, and cuts a progressively expanding frustoconical opening in the hole. When the drilling operation is finished, the downward force of source 80 is terminated, and the bias of spring 82 shifts ram 58 longitudinally upwardly, thereby retracting blades 84, 86 into the sheath. The water source is disconnected and the undercutting tool 10 withdrawn from the hole.

Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not in a limiting sense.

What is claimed as invention is:

1. An expansible rotary power tool for reaming frustoconical undercuts in the walls of cylindrical holes, comprising:

a. an elongated cylindrical sheath, having an enlarged diameter open upper end, a reduced diameter lower end and an axial passageway extending substantially the length of said sheath;

b. said sheath being further provided with a pair of opposing longitudinal slots adjacent said lower end of the tool, communicating with said passageway and each adapted to receive a cutting assembly therein;

c. a tubular ram substantially disposed in reciprocal, sliding relationship within said sheath, said ram having an enlarged diameter upper portion positioned above said sheath upper end and a lower portion extending substantially the length of said axial passageway, said ram being further provided with a power engaging head at the upper portion and a clevis at the lower end thereof, said clevis being disposed adjacent said slots;

d. bias means resting upon a shoulder means on the inside wall of said sheath upper end and biasing said ram by abutting against its upper portion;

e. at least a pair of cutting assemblies being pivotally mounted on the clevis of said ram, and means for extending the lower cutting portion of said cutting assemblies outwardly through said slots when the ram is advanced against the bias of said bias means, said cutting portions substantially overlapping each other during a non-operation;

f. each of said cutting portions being provided with a blade having a diamond impregnated cutting surface, said blade being mounted within a recess in the lowermost part of said cutting portion, the diamond-impregnated cutting surface being disposed at an acute angle to a cutting face of said cutting portion;

g. a load bearing collar assembly mounted in surrounding engagement to said sheath intermediate said upper and lower ends of the sheath for stopping the advancement of the tool into the hole being undercut;

h. a means for introducing fluid into said tubular ram for cooling and flushing said cutting portions during reaming, said means comprising a conduit means providing fluid communication between a source of fluid and axial bore of said ram, said bore extending the length of said ram, said fluid introducing means further comprising a beveled recess in upper parts of said cutting portions for providing a flow of fluid directed at an angle to a longitudinal axis of said tool into said hole and to a place adjacent the position of said blades during operation; said means for introducing said fluid flow cooperating with a means for removing debris from the hole during operation.

2. The apparatus of claim 1, wherein said biasing means is a helical power coil spring disposed in surrounding relationship to said ram between said upper end of the sheath and said head.

3. The apparatus of claim 1, wherein said collar assembly is comprised of:

a. an inner seat having a flanged lip extending outwardly from said seat and a depending skirt disposed in surrounding relationship to said sheath;

b. an outer race disposed in rotatingly surrounding relationship to said inner seat for permitting said inner seat to rotate with said sheath and ram while said outer race remains disposed in stationary abutting relationship with the surface of the concrete surrounding the hole being undercut; said outer race being further provided with a plurality of U-shaped notches along the periphery of its downwardly depending wall, said notches communicating with said hole to assist in removing debris from said hole;

c. a round keeper disposed above said inner seat and fixed to said sheath and inner seat for preventing longitudinal displacement of the collar during reaming.

4. The apparatus of claim 3, wherein said cutting assemblies are pivotally mounted by a pivot carried by said sheath, expanding means being comprised of a pivot carried by said clevis are inserted through a diagonal slot in each of said cutting assemblies, said diagonal slot having its lowermost terminus adjacent said cutting face and its uppermost terminus adjacent and opposite the face of said cutting portion.

5. The apparatus of claim 4, wherein a plane described by said beveled fluid channeling recess is parallel to the longitudinal axis of said diagonal slot.

6. The apparatus of claim 5, wherein the imaginary plane containing the diamond impregnated cutting surface of said blade is disposed at an angle to the surface planes of front and rear cutter surfaces in a range between 1° and 25°.

* * * * *